US010621962B2

(12) United States Patent
Castelli

(10) Patent No.: US 10,621,962 B2
(45) Date of Patent: Apr. 14, 2020

(54) ATTACHABLE GUITAR REST ASSEMBLY

(71) Applicant: Walter Castelli, Stony Point, NY (US)

(72) Inventor: Walter Castelli, Stony Point, NY (US)

( * ) Notice: Subject to any disclaimer, the term of this patent is extended or adjusted under 35 U.S.C. 154(b) by 0 days.

(21) Appl. No.: 16/559,371

(22) Filed: Sep. 3, 2019

(65) Prior Publication Data

US 2020/0074964 A1 Mar. 5, 2020

Related U.S. Application Data

(60) Provisional application No. 62/725,478, filed on Aug. 31, 2018.

(51) Int. Cl.
*G10G 5/00* (2006.01)

(52) U.S. Cl.
CPC ..... *G10G 5/00* (2013.01)

(58) Field of Classification Search
CPC ..... G10G 5/00
See application file for complete search history.

(56) References Cited

U.S. PATENT DOCUMENTS 7,906,717 B2 * 3/2011 Wang ..... G10G 5/00 248/121

2003/0121395 A1 * 7/2003 Smith ..... G10G 5/005 84/327

* cited by examiner

*Primary Examiner* — Kimberly R Lockett
(74) *Attorney, Agent, or Firm* — McLean Law LLC; Kimberly McLean, esq

(57) ABSTRACT

A guitar rest assembly device including a rest frame assembly and a locking mechanism. The rest frame assembly including a base frame member and a stand support frame member. The base frame member includes a vertically oriented support bar element having a lock aperture at a top region, a back support element affixed to the support bar element for supporting a received guitar object and a base rest element for receiving a base of the received guitar object. The base rest element attaches to a distal end of the support bar element in a perpendicular orientation and includes an aperture for receiving a first attachment element for connecting the base rest element to the base of the received guitar object. The stand support frame member includes a pair of stand leg elements which are attached to the support bar element thereby forming a tripod stand structure. Each stand leg element includes a mating lock aperture at a top region. The locking mechanism pierces the mating lock apertures of each stand leg element and the lock aperture of the support bar element to transition the pair of stand leg elements between a locked open position and a locked closed position.

10 Claims, 5 Drawing Sheets

ATTACHABLE GUITAR REST ASSEMBLY

CROSS-REFERENCE TO RELATED APPLICATION

This application claims priority benefit of U.S. Provisional Application 62/725,478 filed on Aug. 31, 2018, the disclosure of which is incorporated herein by reference in its entirety.

FIELD OF THE INVENTION

Embodiments described herein generally relate to a guitar stand, and more particularly to a convertible and attachable guitar stand.

BACKGROUND OF THE INVENTION

A guitar is a musical instrument that is played with the use of a musician's hand. Normally, a musician drapes the guitar over their shoulder and the strings of the guitar are available along the frets for active musical engagement. The typical guitar player when performing a live performance places the guitar on a guitar stand during breaks. Further some individuals may store their guitar on a guitar stand at home. A typical guitar stand is a tripod arrangement with a backing to allow placement of the guitar. The stand is an essential tool that is used by most guitar owners. However, the guitar stand creates yet another tool or device that must be stored and transported by a typical guitar musician. The guitar stand may take up additional space and some guitar stands are bulky to handle.

It's the object of the present invention to provide an attachable guitar stand that attaches to the guitar and may easily be extended and mounted on the floor along with the guitar creating a convertible guitar rest.

BRIEF DESCRIPTION OF THE DRAWINGS

The various advantages of the embodiments of the present disclosure will become apparent to one skilled in the art by reading the following specification and appended claims, and by referencing the following drawings, in which:

SUMMARY OF THE INVENTION

Figure 1:
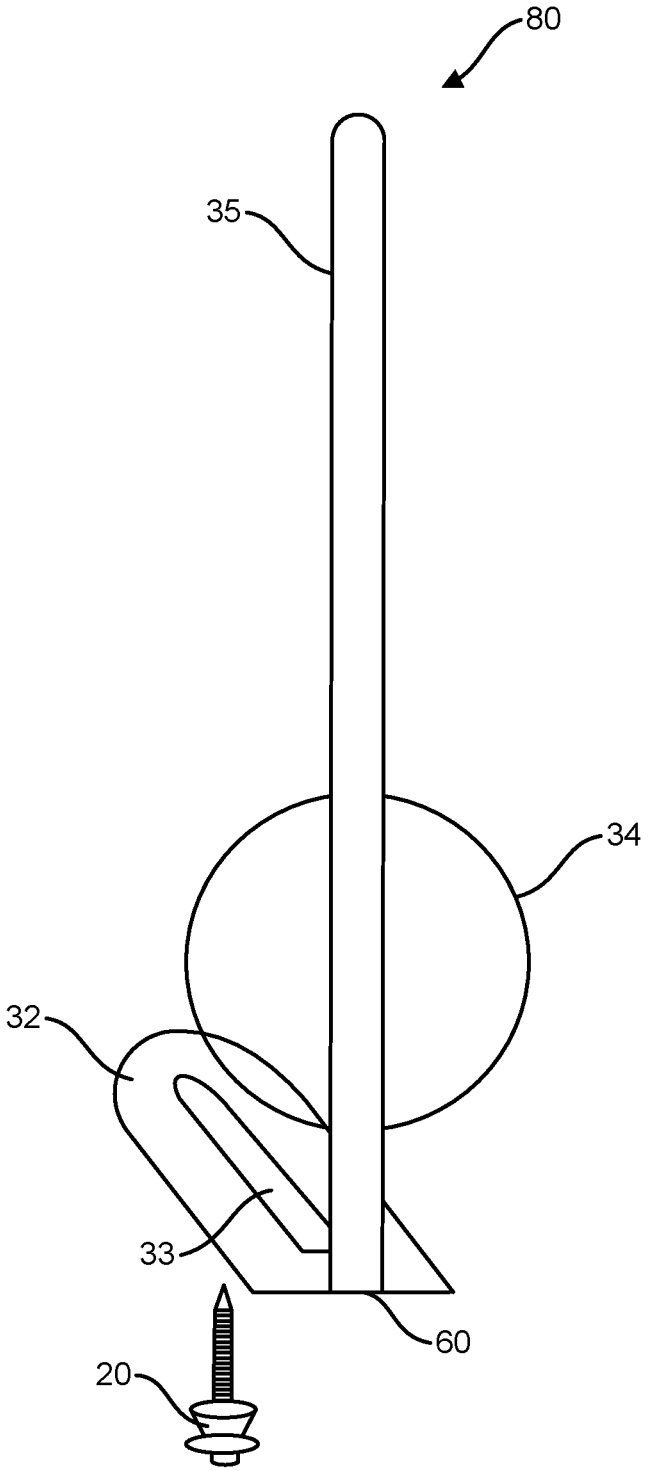
FIG. 1 shows a perspective view of an exemplary base frame member of the guitar rest assembly device according to an embodiment of the present disclosure.

Exemplary embodiments disclosed herein describe a guitar rest assembly device. The guitar rest assembly device includes a rest frame assembly and a locking mechanism. The rest frame assembly including a base frame member and a stand support frame member. The base frame member includes a vertically oriented support bar element having a lock aperture at a top region, a back support element affixed to the support bar element for supporting a received guitar object and a base rest element for receiving a base of the received guitar object. The base rest element attaches to a distal end of the support bar element in a perpendicular orientation and includes an aperture for receiving a first attachment element for connecting the base rest element to the base of the received guitar object. The stand support frame member includes a pair of stand leg elements which are attached to the support bar element thereby forming a tripod stand structure. Each stand leg element includes a mating lock aperture at a top region. The locking mechanism pierces the mating lock apertures of each stand leg element and the lock aperture of the support bar element to transition the pair of stand leg elements between a locked open position and a locked closed position.

In some exemplary embodiments, the first attachment element is a guitar strap bolt.

In some exemplary embodiments, the pair of stand leg elements each include a non-slip grip element.

In some exemplary embodiments, the pair of stand leg elements each include a plurality of second attachment elements for receiving an interchangeable object.

In some exemplary embodiments, the received interchangeable object includes a stabilization pad.

In some exemplary embodiments, the received interchangeable object includes decorative ornamentation.

In some exemplary embodiments, the locking mechanism is a hinge system.

In some exemplary embodiments, the back support element includes a lining to protect the received guitar object.

In some exemplary embodiments, the base rest element includes a sliding adjustable slit to adjust the size of the base rest element to accommodate different size guitars.

In some exemplary embodiments, the plurality of second attachment elements are clips or magnets.

DETAILED DESCRIPTION

The present invention is a guitar rest assembly that is attachable to a guitar. The guitar rest assembly is portable and includes an interchangeable decorative piece in the shape of a treble clef that can be connected to both sides of the tripod-type guitar rest. The guitar rest includes two supporting legs and includes a rubber backing that attaches directly to the back of the guitar. A base rest element is provided extending perpendicularly from a support base and bolts onto the end of the guitar. The stand folds conveniently during use of the guitar. The guitar rest assembly has a thin structure so that it does not get in the way or effect the playing of the guitar. The guitar rest assembly may be made out any suitable material or any suitable combination of materials, such as, for example, metal and plastic.

Turning to FIGS. 1-5, the guitar rest assembly device ("the device") includes a rest frame assembly 75 (shown in FIG. 3) and a locking mechanism 39. The rest frame assembly may include a base frame member 80 (shown in FIG. 1) attached to a stand support frame member (30*a*, 30*b*). The base frame member 80 may include a vertically oriented support bar element 35 for supporting a received guitar object 50, a back support element 34 affixed to the support bar element 35 for supporting a received guitar object 50, and a base rest element 32 for receiving the base end of a received guitar object 50.

The support bar element 35 has a lock aperture 38 located at its top region for receiving locking mechanism 39. The base rest element 32 may have a "D" like shape and may include a slot opening 33 (i.e. aperture). The base rest element 32 may include a sliding adjustable slit to adjust the size of the base rest element to accommodate different size guitars. The base rest element 32 attaches to distal end 60 of support bar element 35 in a perpendicular orientation. The slot opening 33 may receive a first attachment element 20 for connecting the base rest element 32 to the base of the guitar object 50. In some exemplary embodiments, the first attachment element for connecting the base rest element to the base of the guitar object is a guitar strap bolt. The guitar strap bolt pierces slot opening 33 and connects to the opening at the base of the guitar for receiving the guitar strap bolt.

The back support element 34 may include a rubber lining backing. The back support element includes the lining to protect the received guitar object in a manner that it does not affect the sound of the guitar or damage/scratch the guitar in any way. The support bar element 35 with rubber lining backing 34 abuts directly against the guitar object 50 during use with the device. Attachment of the support bar element 35 to guitar object 50 is shown in FIG. 2.

Figure 2:
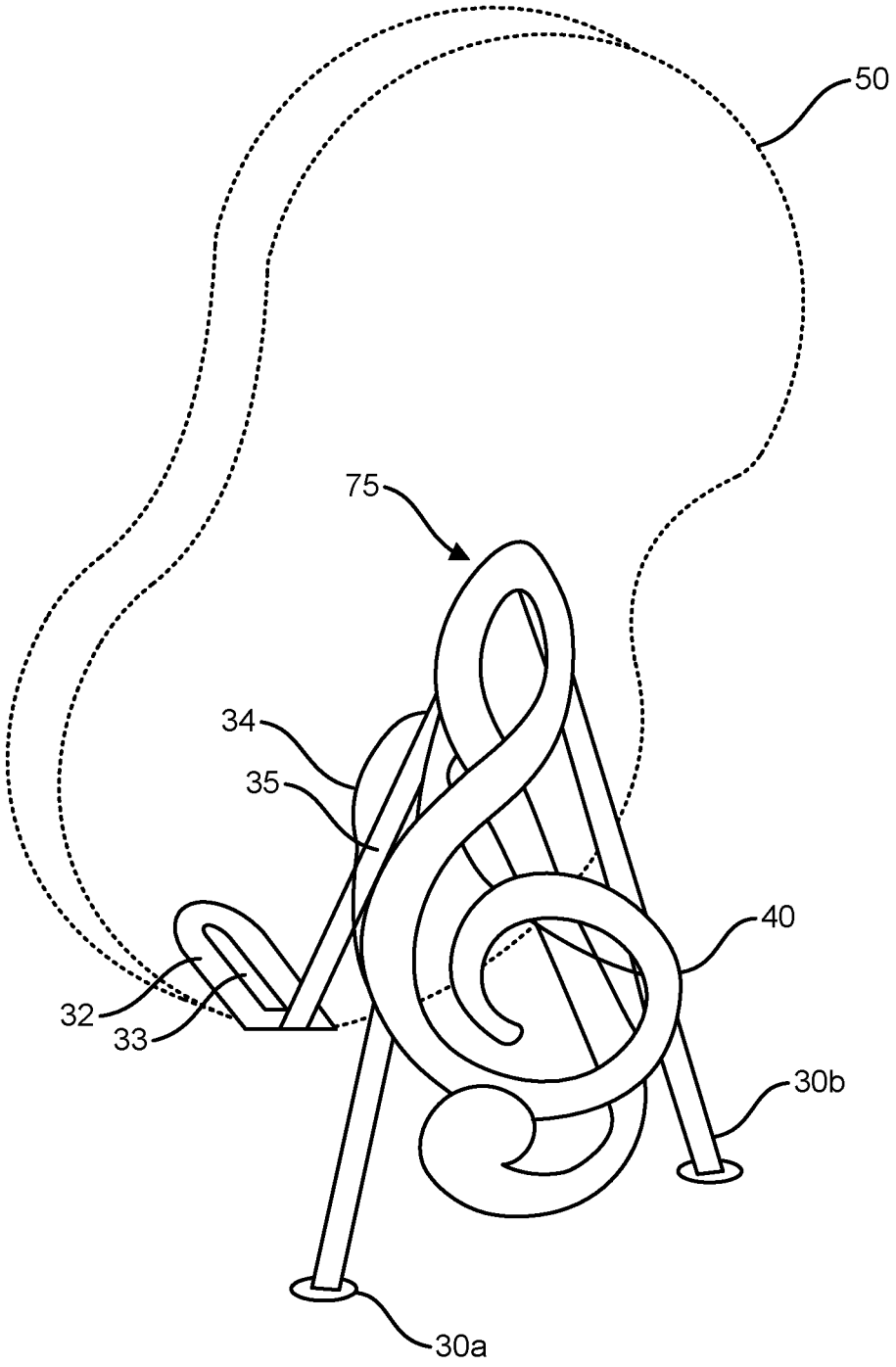
FIG. 2 shows an exemplary depiction of the guitar rest assembly device attached to a guitar according to an embodiment of the present disclosure.
Figure 3:
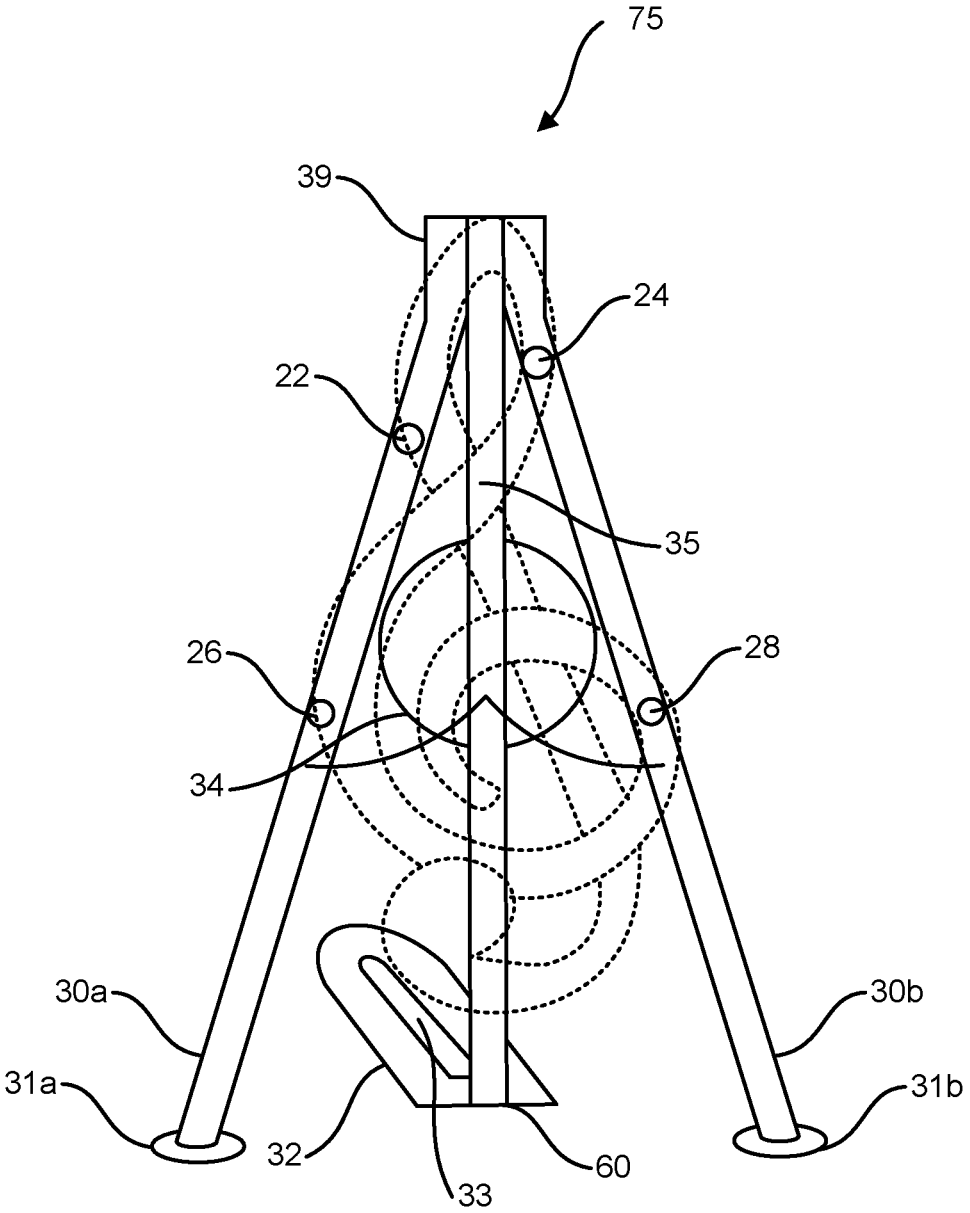
FIG. 3 shows an exemplary guitar rest assembly device according to an embodiment of the present disclosure.

The stand support frame member includes a pair of stand leg elements 30*a*, 30*b* which are attached to the support bar element 35 thereby forming a tripod stand structure as shown in FIGS. 2 and 3. The tripod stand structure maintains the resting guitar in an upright position. Each stand leg element includes a non-slip grip element 31*a*, 31*b* at the bottom of each leg element to prevent the leg elements from slipping on a surface. Each stand leg element includes a mating lock aperture at a top region for receiving locking mechanism 39. Further, each leg element includes a plurality of second attachment elements for receiving an interchangeable object 40. In some exemplary embodiments, the plurality of second attachment elements may include clips (i.e., clip-ons) or snaps. The interchangeable object may include a plastic overplate to give the back of the resting guitar more support. The interchangeable object may include a comfort pad for stabilization and decorative ornamentation for aesthetics. In some exemplary embodiments, the decorative ornamentation includes a shape of a G-Clef.

The locking mechanism 39 may position the pair of stand leg elements 30*a*, 30*b* in a locked open position and a locked closed position. In some exemplary embodiments, the locking mechanism is a hinge system; however, any other suitable mechanical locking mechanisms may be used. When the stand leg elements are locked in an open position, the guitar object 50 may rest on the stand while the stand is stationary in a location. When the stand legs are locked in a closed position, the guitar object may remain attached to the stand while the tripod stand structure is in a collapsed position for transporting. During use, the device toggles between a locked open position and a locked closed position.

Figure 4:
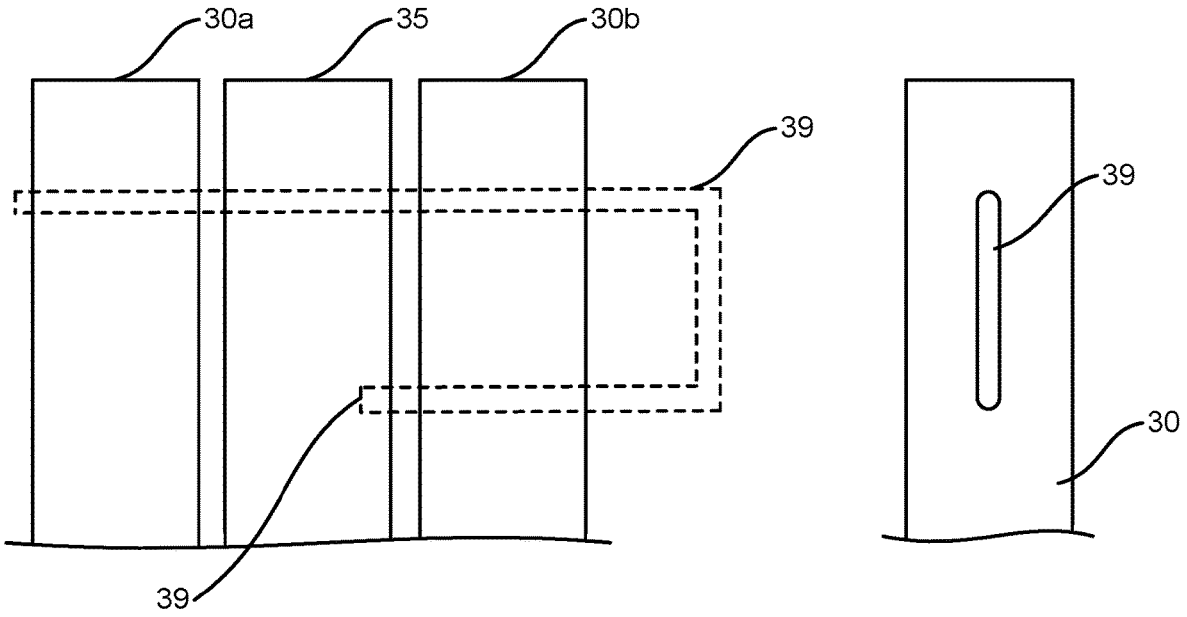
FIG. 4 shows an exemplary view of a locking mechanism for the guitar rest assembly device according to an embodiment of the present disclosure.
Figure 5:
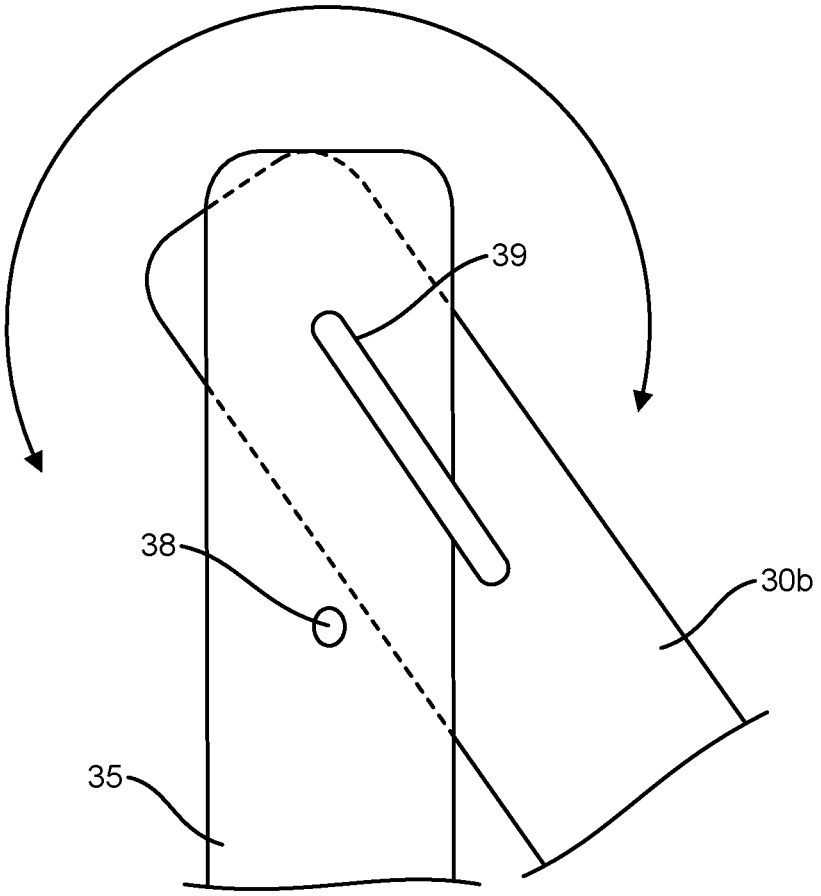
FIG. 5 shows an exemplary side view depiction of rotation movement when opening and closing the leg elements.

The locking mechanism 39 is shown in FIG. 4 with a partial view of support bar 35 and legs 30*a*, 30*b* on each side of the support bar 35. The locking mechanism 39 extends (i.e., pierces) through both legs 30*a*, 30*b* and the center of support bar 35. An opening 38 is provided in the support bar 35 that allows for the fixation of the locking mechanism 39 to a closed position. FIG. 5 demonstrates movement of the legs 30*a*, 30*b* in relation to support bar 35 with a side view. On this side view, leg 30*b* is extended in an open position and the opening 38 is shown on the support bar 35 of the locking mechanism 39.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The exemplary embodiment was chosen and described in order to best explain the principles of the invention and its practical application, to thereby enable others skilled in the art to best utilize the invention and various embodiments with various modifications as are suited to the particular use contemplated.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, one skilled in the art will recognize such feature, structure, or characteristic in connection with other embodiments whether or not explicitly described.

The disclosed embodiments are not inclusive and many other modifications and variations will be apparent to someone of ordinary skill in the art with construction skills in the related arts. Together the descriptions and accompanying illustrations seek to provide an explanation of the basic principles of the embodiment and its application. It is therefore intended that the specification and embodiments be considered as exemplary only.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A guitar rest assembly device comprising:

a rest frame assembly having a base frame member attached to a stand support frame member, the base frame member including a vertically oriented support bar element having a lock aperture at a top region, a back support element affixed to the support bar element for supporting a received guitar object and a base rest element for receiving a base of the received guitar object, the base rest element attaches to a distal end of the support bar element in a perpendicular orientation and includes an aperture for receiving a first attachment element for connecting the base rest element to the base of the received guitar object, the stand support frame member including a pair of stand leg elements which are attached to the support bar element thereby forming a tripod stand structure, each stand leg element including a mating lock aperture at a top region; and a locking mechanism for piercing the mating lock apertures of each stand leg element and the lock aperture of the support bar element to transition the pair of stand leg elements between a locked open position and a locked closed position.

2. The device of claim 1, wherein the first attachment element is a guitar strap bolt.

3. The device of claim 1, wherein the pair of stand leg elements each include a non-slip grip element.

4. The device of claim 1, wherein the pair of stand leg elements each include a plurality of second attachment elements for receiving an interchangeable object.

5. The device of claim 4, wherein the received interchangeable object includes a stabilization pad.

6. The device of claim 5, wherein the received interchangeable object includes decorative ornamentation.

7. The device of claim 1, wherein the locking mechanism is a hinge system.

8. The device of claim 1, wherein the back support element includes a lining to protect the received guitar object.

9. The device of claim 1, wherein the base rest element includes a sliding adjustable slit to adjust the size of the base rest element to accommodate different size guitars.

10. The device of claim 4, wherein the plurality of second attachment elements are clips or magnets.

* * * * *